US009510073B2

(12) United States Patent
Park et al.

(10) Patent No.: US 9,510,073 B2
(45) Date of Patent: Nov. 29, 2016

(54) AIR CONDITIONER HAVING AN AUDIO COLLECTING DEVICE

(71) Applicant: LG ELECTRONICS INC., Seoul (KR)

(72) Inventors: Sanggil Park, Seoul (KR); Yeol Lee, Seoul (KR); Jungwoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 340 days.

(21) Appl. No.: 14/279,916

(22) Filed: May 16, 2014

(65) Prior Publication Data

US 2014/0341414 A1 Nov. 20, 2014

(30) Foreign Application Priority Data

May 20, 2013 (KR) ..... 10-2013-0056407

(51) Int. Cl.

| | |
|---|---|
| ***H04R 1/28*** | (2006.01) |
| ***H04R 1/08*** | (2006.01) |
| ***H04R 1/02*** | (2006.01) |
| ***F24F 13/20*** | (2006.01) |
| ***F24F 11/00*** | (2006.01) |
| *F24F 13/24* | (2006.01) |

(52) U.S. Cl.

CPC ..... *H04R 1/08* (2013.01); *F24F 11/001* (2013.01); *F24F 13/20* (2013.01); *H04R 1/028* (2013.01); *F24F 2011/0053* (2013.01); *F24F 2013/242* (2013.01)

(58) Field of Classification Search

CPC ..... H04R 1/08; H04R 1/028; H04R 1/02; H04R 1/28; H04R 1/025; H04R 2201/02; H04R 2201/029; F24F 11/006; F24F 11/001; F24F 2011/0053; F24F 2011/0057; F24F 2011/0068; F24F 13/20

USPC ..... 381/365, 91, 122, 355, 360, 361, 87, 381/386

See application file for complete search history.

(56) References Cited

U.S. PATENT DOCUMENTS

| | | | | |
|---|---|---|---|---|
| 4,448,035 | A | 5/1984 | Moriyama et al. | 62/176.6 |
| 5,010,739 | A * | 4/1991 | Isshiki | F04D 27/004 181/175 |
| 2012/0008805 | A1* | 1/2012 | Hachinohe | B81B 7/0064 381/163 |
| 2012/0328142 | A1 | 12/2012 | Horibe et al. | 381/355 |

FOREIGN PATENT DOCUMENTS

| | | |
|---|---|---|
| CN | 102478297 | 5/2012 |
| GB | 2 236 200 A | 3/1991 |
| WO | WO 2011/029401 A1 | 3/2011 |

OTHER PUBLICATIONS

European Search Report dated Nov. 14, 2014, issued in Application No. 14168844.0.
Chinese Office Action dated Jun. 27, 2016.

* cited by examiner

*Primary Examiner* — Ahmad F Matar
*Assistant Examiner* — Sabrina Diaz
(74) *Attorney, Agent, or Firm* — Ked & Associates LLP

(57) ABSTRACT

An air conditioner is provided. The air conditioner may include a body including an outlet and an audio collecting device provided on one side of the outlet, the audio collecting device including a microphone that collects audio input. The audio collecting device may include a housing body including an opening in which the microphone is installed, a housing cover provided on one side of the housing body, and a noise insulation space defined by the housing body and the housing cover. The microphone may be received in the noise insulation space.

19 Claims, 11 Drawing Sheets

AIR CONDITIONER HAVING AN AUDIO COLLECTING DEVICE

CROSS-REFERENCE TO RELATED APPLICATION(S)

This application claims priority under 35 U.S.C. §119 to Korean Application No. 10-2013-0056407 filed in Korea on May 20, 2013, whose entire disclosure is hereby incorporated by reference.

BACKGROUND

1. Field

This relates to an air conditioner.

2. Background

Air conditioners may maintain indoor air at an appropriate condition for its use or purpose. In other words, air conditioners may provide cooling to a room to be cooled in summer and heating to a room to be warmed in winter, may control indoor humidity levels, and may clean/filter indoor air. Air conditioners may include, for example, a compressor, a condenser, an expander, and a vaporizer arranged in a cooling cycle and driven to provide cooling and heating.

An air conditioner may include an inlet for drawing air in from an indoor space, a heat exchanger for heat-exchanging the air drawn in through the inlet, and an outlet for discharging the air heat-exchanged by the heat exchanger into the indoor space. Air conditioners may also include with a ventilating fan for generating an air flow from the inlet to the outlet.

Air conditioners may be configured to allow a user to directly operate an input device to select a certain mode of operation or to use a remote control to control operation from a separate location.

BRIEF DESCRIPTION OF THE DRAWINGS

The embodiments will be described in detail with reference to the following drawings in which like reference numerals refer to like elements wherein.

DETAILED DESCRIPTION

Hereinafter, exemplary embodiments will be described in detail with reference to the drawings. However, embodiments are not limited thereto, and one of ordinary skill in the art may easily provide other embodiments within a range of the scope as broadly described herein.

When a user would like to directly operate an input device of an air conditioner, it may be necessary to have access to the air conditioners within a reasonable control distance. Using a remote control may increase this control distance. However, when the remote control is lost, control operations may be limited. A method of controlling operation of the air conditioners using a microphone and audio/voice control commands may be considered.

However, although using a voice recognition method may be employed in using a microphone to control operation of the air conditioner, it may be difficult to properly collect voice/audio signals and/or to filter various noises in the vicinity of the microphone, for example, noise generated by outside air conditioners, outdoor airborne sounds, noise associated with discharged air flow, airborne sounds inside air conditioners, noises caused by vibrations of air conditioners and the like. When voice/audio input is improperly collected, a voice recognition rate may decrease, making it difficult to properly control the air conditioner.

Figure 1:
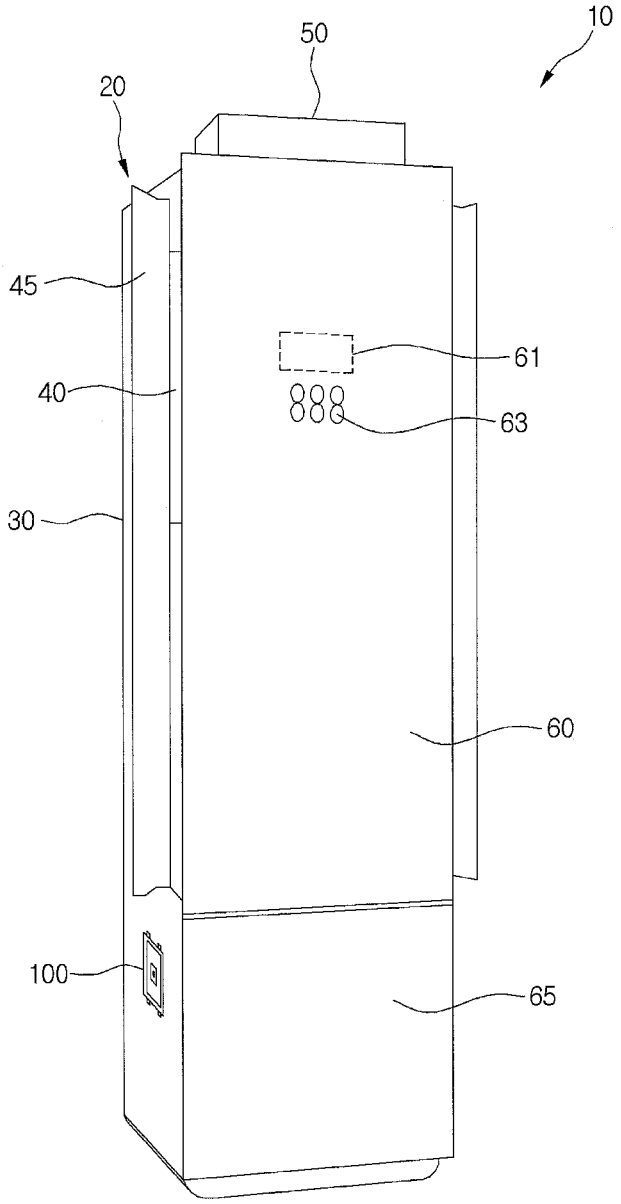
FIG. 1 is a perspective view of an air conditioner according to an embodiment as broadly described herein.
Figure 2:
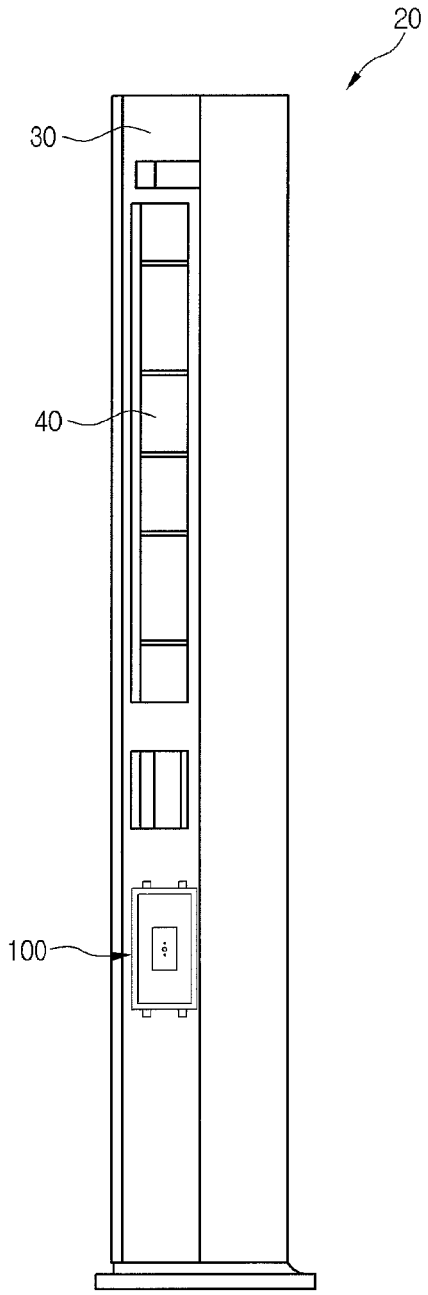
FIG. 2 is a partial view of the air conditioner shown in FIG. 1.

Referring to FIGS. 1 and 2, an air conditioner 10 as embodied and broadly described herein may include a body 20 provided with an inlet and outlets 40 and 50. The air conditioner 10 may be an indoor unit installed in an indoor space and discharging the air. A heat exchanger and a ventilating fan may be provided in the body 20.

The inlet may be formed on a rear of the body 20. The outlets 40 and 50 may include a side outlet 40 allowing the air sucked through the inlet to be discharged forwards or laterally from the body 20 and a top outlet 50 allowing the air to be discharged upward from the body.

The side outlet 40 may be formed on both sides of the body 20 and a degree of opening of the side outlet 40 may be controlled by a discharge vane 45. The discharge vane 45 may be pivotable.

The top outlet 50 may be selectively open according to an operation of the air conditioner 10. In detail, when the air conditioner 10 is turned on, the top outlet 50 may be transferred to project upwards from a top of the body 20. When the air conditioner 10 is turned off, the top outlet 50 may be transferred downwards to be contained in the body 20.

The body 20 includes a side panel 30 forming a lateral external shape of the air conditioner 10. The side panel 30 may be provided on both sides of the body 20 and may include the side outlet 40.

A portion of the side outlet 40, for example, a bottom portion thereof may be provided with a voice collecting device 100, or audio collecting device 100, capable of collecting audio inputs, such as voices of a user. As an example, the audio collecting device 100 may be provided on a left side or a right side of the body 20.

A front of the body 20 is provided with front panels 60 and 65. The front panels 60 and 65 form the front external shape of the air conditioner 10. The front panels 60 and 65 include a top front panel 60 and a bottom front panel 65.

The top front panel 60 includes a display 61 displaying information on operations of the air conditioner 10 and an input device 63 for inputting an operation command to the air conditioner 10.

Hereinafter, a configuration of the audio collecting device 100 will be described with reference to the drawings.

Figure 3:
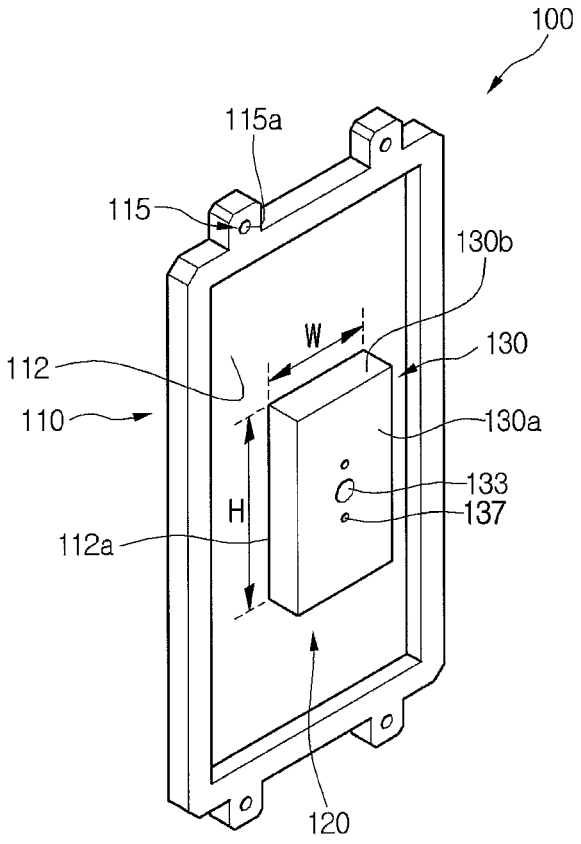
FIG. 3 is a front view of an audio collecting device shown in FIG. 1.
Figure 4:
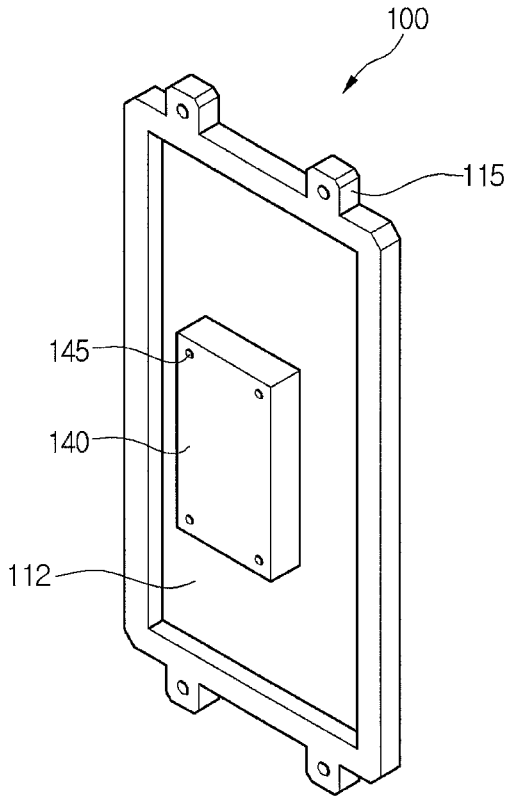
FIG. 4 is a rear view of the audio collecting device shown in FIG. 1.
Figure 5:
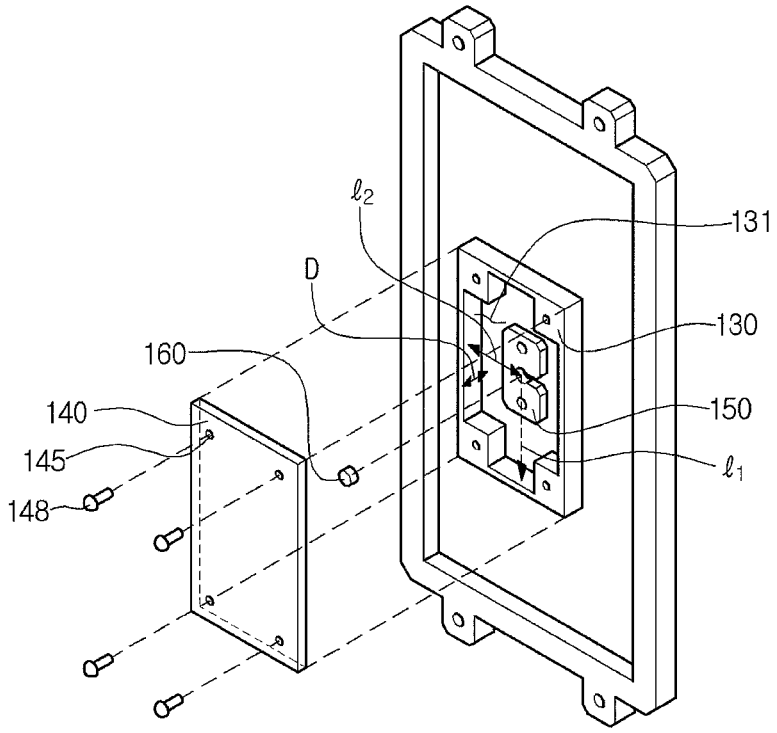
FIG. 5 is an exploded perspective view of the audio collecting device shown in FIG. 1.
Figure 6:
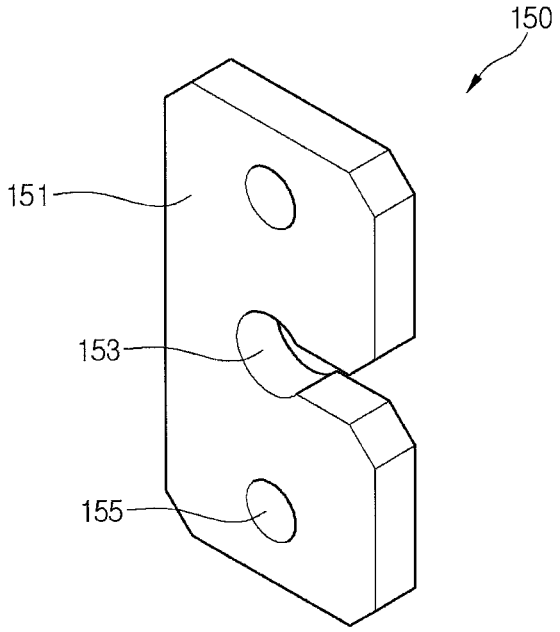
FIG. 6 is a perspective view of a supporting device shown in FIG. 5.

FIG. 3 is a front perspective view of the audio collecting device 100, FIG. 4 is a rear perspective view, FIG. 5 is an exploded perspective view, and FIG. 6 is a perspective view of a supporting device 150.

Referring to FIGS. 3 to 6, the audio collecting device 100 includes a coupling device 110 separably coupled with the side panel 30 to be separable and a housing 120 mounted on the coupling device 110 and containing a microphone therein.

In detail, the coupling device 110 includes a mounting part 112 supporting the housing 120 and one or more panel coupling parts 115 coupled with the side panel 30.

The mounting part 112 includes a coupling hole 112*a* coupled with the housing 120. The housing 120 may pass through the coupling hole 112*a*. That is, the housing 120 may be inserted into the coupling hole 112*a* and then may be coupled with the mounting part 112.

The panel coupling part 115 may be a plurality of panel coupling parts 115 on one side and another side of the mounting part 112, each including a penetration hole 115*a* coupled with a fastener. The panel coupling part 115 may be coupled with the side panel 30 by the fastener.

The housing 120 may have an approximate hexahedral shape forming an inner space.

The housing 120 includes a housing body 130 exposed outwards from the coupling device 110 and a housing cover 140 coupled with one side of the housing body 130. In detail, the housing body 130 is coupled with the mounting part 112, projects from through the coupling hole 112*a*, and extends to a rear side of the mounting part 112 through the coupling hole 112*a*.

The housing body 130 is coupled with the housing cover 140, thereby forming an inner space 131 for shutting out noises. In the inner space 131, a microphone 160 may be disposed.

The housing body 130 includes a first wall 130*a* forming a front surface of the housing 120 and a plurality of second walls 130*b* extending to a rear of the first wall 130*a*, that is, to the inside of the side panel 30.

Herein, "a front" or "a front surface" designates a direction facing toward the outside of the side panel 30 and "a rear" or "a rear surface" designates a direction facing toward the inside of the side panel 30, that is, the inside of the air conditioner 10.

The second walls 130*b* form four surfaces projecting forwards from the mounting part 112, and the first wall 130*a* is coupled with a front edge of the four second walls 130*b*. The second walls 130*b* may define a depth D between the front and rear of the inner space of the housing 120.

The second walls 130*b* are formed to have a lateral length matching a lateral width of the housing 120 to be a width W and to have a longitudinal length matching a longitudinal height of the housing 120 to be a height H. The width W and the height H have greater values than a lateral width and a longitudinal height of the microphone 160, respectively.

The first wall 130*a* is formed with a microphone installation hole 133 so that the microphone 160 may be exposed outwards and a first coupling hole 137 receiving a fastener coupled with the supporting device 150.

The microphone installation hole 133 is understood as an opening of the housing 120 to allow voices from the outside to be transferred to the microphone 160. Also, the supporting device 150 supports the microphone 160 on the inside of the first wall 130*a*.

The housing cover 140 is located on a rear side of the mounting part 120 and not exposed outwards from the air conditioner 10.

The housing cover 140 is formed with a plurality of body coupling parts 145 for allowing the housing cover 140 to be coupled with housing body 130 using fasteners 148. The housing cover 140 is coupled with the housing body 130, thereby allowing the inner space 131 of the housing 120 to be shielded from the outside.

The inner space 131 is not necessarily a sealed space or a vacuum but may have a size capable of insulating or shutting out noises having a certain frequency.

A length from the housing cover 140 to the first wall 130*a* of the housing body 130, that is, a depth from front to rear of the housing 120 may be a depth D. The depth D has a greater value than a length from front to rear of the microphone 160.

As shown in FIG. 5, a distance from the microphone 160 to one of the plurality of second walls 130*b*, for example, a vertical distance to the second wall 130*b* below the microphone 160, is a distance l1 and a distance from the microphone 160 to another of the plurality of second walls 130*b*, for example, a horizontal distance to the second wall 130*b* beside the microphone 160 is a distance l2. Also, a distance from the microphone 160 to the housing cover 140 is a distance l3 (refer to FIG. 7).

The distances l1 and l2 may have greater values than a longitudinal length and a lateral length of the microphone 160, respectively.

Values of the width W, the height H, the depth D, and the distances l1, l2, and l3 may be properly selected as factors for defining the inner space 131 to effectively shut out noises occurring in the air conditioner 10, particularly, noises having a low frequency of 500 Hz or less.

The microphone 160 is installed in the housing 120 for collecting voices occurring outside the air conditioner 10, with the supporting device 150 stably supporting the microphone 160 on the first wall 130*a*.

The supporting device 150 is formed with a supporting body 151 coupled with a rear surface of the first wall 130*a* of the housing body 130 and an insertion hole 153 formed as a notch in the supporting body 151. At least one part of the insertion hole 153 may be round, corresponding to a shape of the microphone 160.

The supporting member 150 includes a second coupling hole 155 to be aligned with the first coupling hole 137 of the first wall 130*a*. The first coupling hole 137 and the second coupling hole 155 may be coupled with each other by a fastener. The second coupling hole 155 may be provided in plurality on both sides of the insertion hole 153, and the first coupling hole 137 may be provided in plurality corresponding to the second coupling holes 155.

The supporting device 150 may prevent separation of the microphone 160 from the housing 120 due to vibrations occurring while operating the air conditioner 10 and/or prevent vibrations occurring in the microphone 160.

Figure 7:
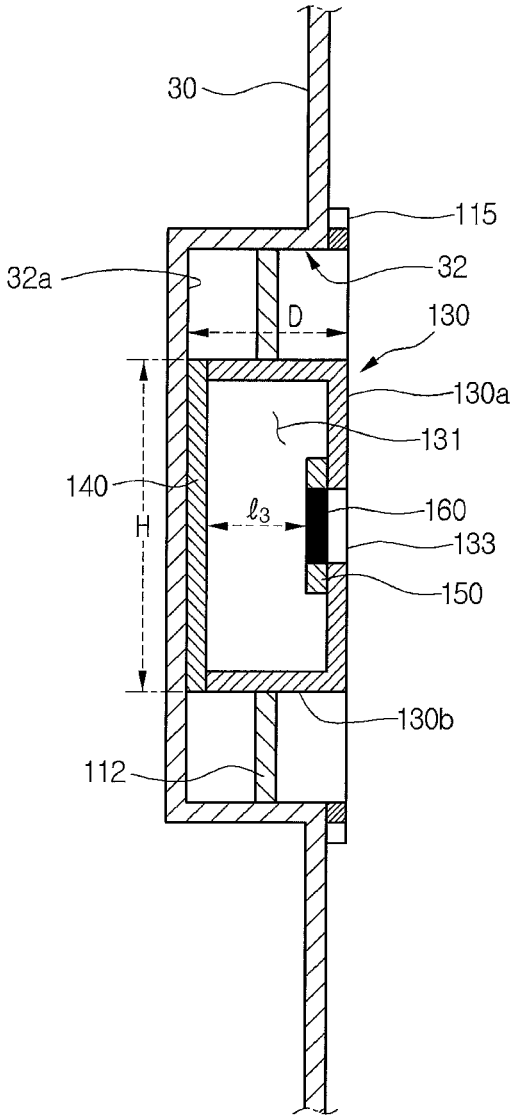
FIG. 7 is a cross-sectional of the audio collecting device coupled to a side panel.
Figure 8:
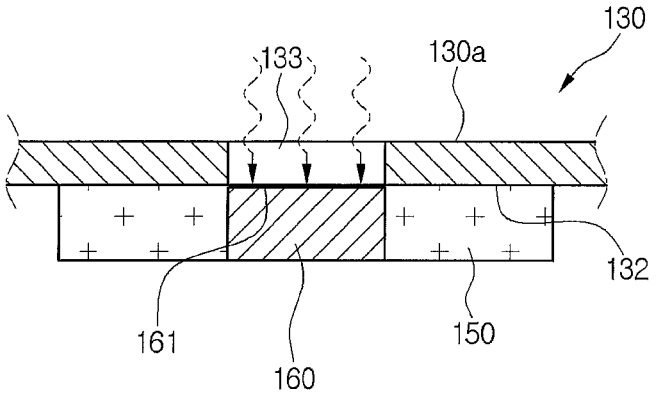
FIG. 8 is a cross-sectional view of a location installed with a microphone shown in FIG. 3.
Figure 9:
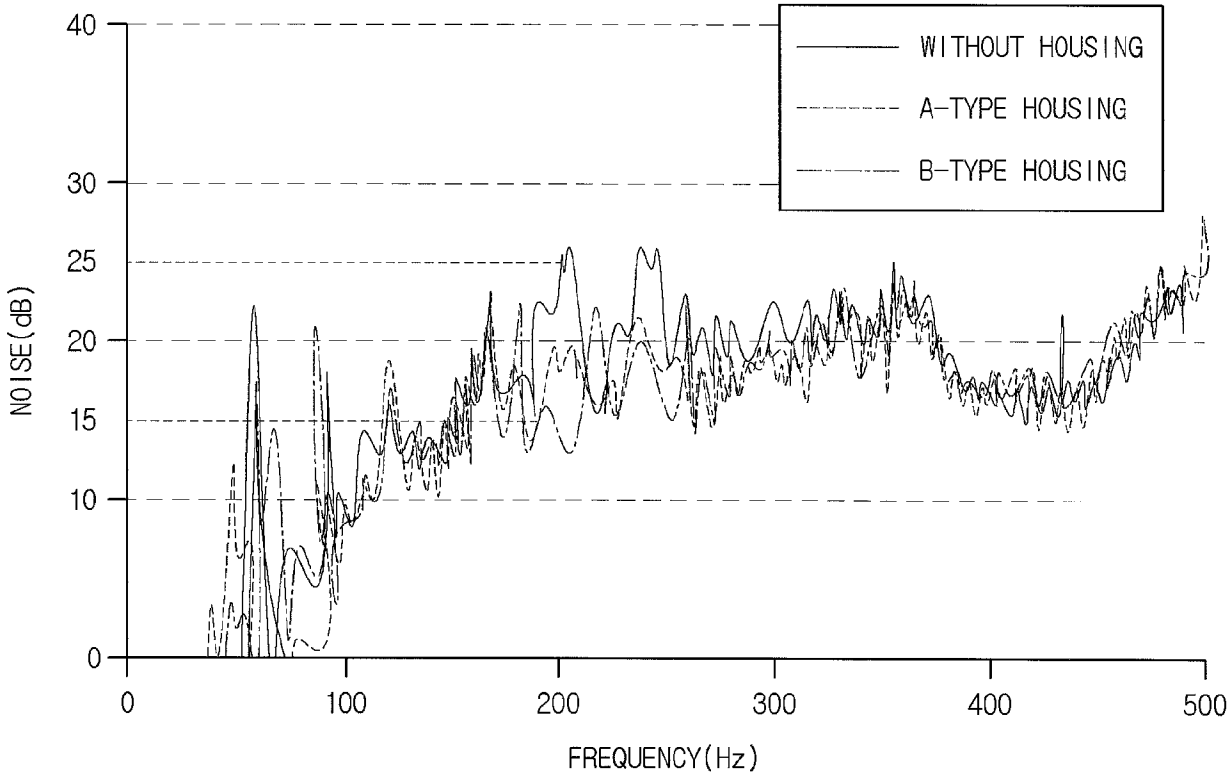
FIG. 9 is a graph illustrating reduced noise levels experienced when the microphone is installed in a housing, according to embodiments as broadly described herein.

FIG. 7 is a cross-sectional view of the audio collecting device 100 coupled with the side panel 30, FIG. 8 is a cross-sectional view of a location installed with the microphone 160, and FIG. 9 is a graph of noise reduction when the microphone 160 is installed in the housing 120.

Referring to FIGS. 7 and 8, the side panel 30 includes a dent part 32, or installation recess 132, containing the housing 120. The recess 132 extends from one surface of the side panel 30 toward the inside of the body 20.

The mounting part 112 is provided inside the recess 132, with two of the mounting part 112 configured to be coupled with the recess 32. Also, the recess 32 includes a seating surface 32*a* allowing the housing cover 140 to be seated thereon. The seating surface 32*a* forms one surface of the recess 32.

The microphone 160 is closely attached to a rear of the microphone installation hole 133.

As shown in FIGS. 3 and 7, the housing 120 forms the inner space 131 having the width W, the height H, and the depth D and the microphone 160 is disposed in the inner space 131 to be separate from the housing cover 140. The microphone 160 is also disposed to be separate from at least one part of the housing body 130.

Particularly, the microphone 160 may be vertically separate from upper and lower the second walls 130*b* of the housing body 130 by the distance l1 and horizontally separate from the two lateral second walls 130*b* by the distance l2, and may be separate from the housing cover 140 by the distance l3.

As described above, since noises transferred from the plurality of walls 130*a*, 130*b*, and 140 forming the housing 120 may be insulated or shut out through the inner space 131, noises applied to the microphone 160 may be reduced.

Referring to FIG. 8, the microphone 160 is disposed to be adjacent or closely attached to an inner surface 132 of the first wall 130*a*, at an area corresponding to the microphone insertion hole 133. That is, the microphone 160 may be located to allow a front 161 of the microphone 160 to form the same surface together with, or to be co-planar with, the inner circumferential surface 132. Accordingly, voices occurring outside the air conditioner 10 may be directly transferred to the microphone 160 through the microphone installation hole 133.

Referring to FIG. 9, results of experiments are presented with respect to degrees of noise occurring when the microphone 160 is disposed in the inner space 131 of the housing 120 and when the housing 120 is not provided, as a comparative example. Experiments were also performed with respect to different sizes of the housing 120, that is, sizes of the width W, the height H, and the depth D, among cases of disposing the microphone 160 in the inner space 131 of the housing 120. For example, respective values of the width W, the height H and the depth of a B type housing may be two times greater than respective values of the width W, the height H and the depth of an A type housing.

As shown in FIG. 9, it is possible to know that when a noise source of a certain frequency occurs in the air conditioner 10, a volume of the corresponding noise source is greater when a housing is not provided for installation of the microphone 160.

Particularly, the frequency of the noise source occurring in the air conditioner 10 includes a low frequency of about 500 Hz or less. Within a range of the corresponding frequency, greater noises occur in the comparative example. On the contrary, noises having approximately similar volumes occur in case of the A type and the B type.

As an example, when a noise source having a frequency of about 200 Hz occurs, in case of the comparative example, noises of about 25 dB are applied to the microphone 160 but in cases of the A type and the B type, noises of about 15 dB are applied to the microphone 160.

As described above, since the housing 120 is provided for installation of the microphone 160 and the inner space 131 is capable of insulating noises, that is, a noise insulation space may be provided in the housing 120, a volume of noise applied to the microphone 160 may be reduced.

Also, since the housing 120 or the noise insulation space has a size capable of shutting out noises having a frequency within a certain range, noise insulating properties may be improved.

Figure 10A:
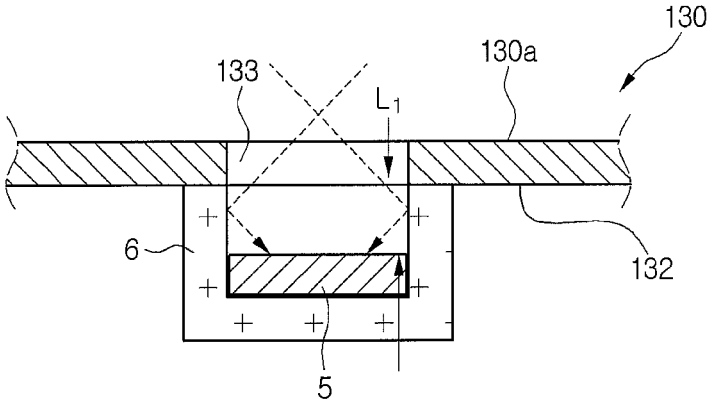
FIG. 10A is a cross-sectional view of the microphone installed separate from an opening of the housing.
Figure 10B:
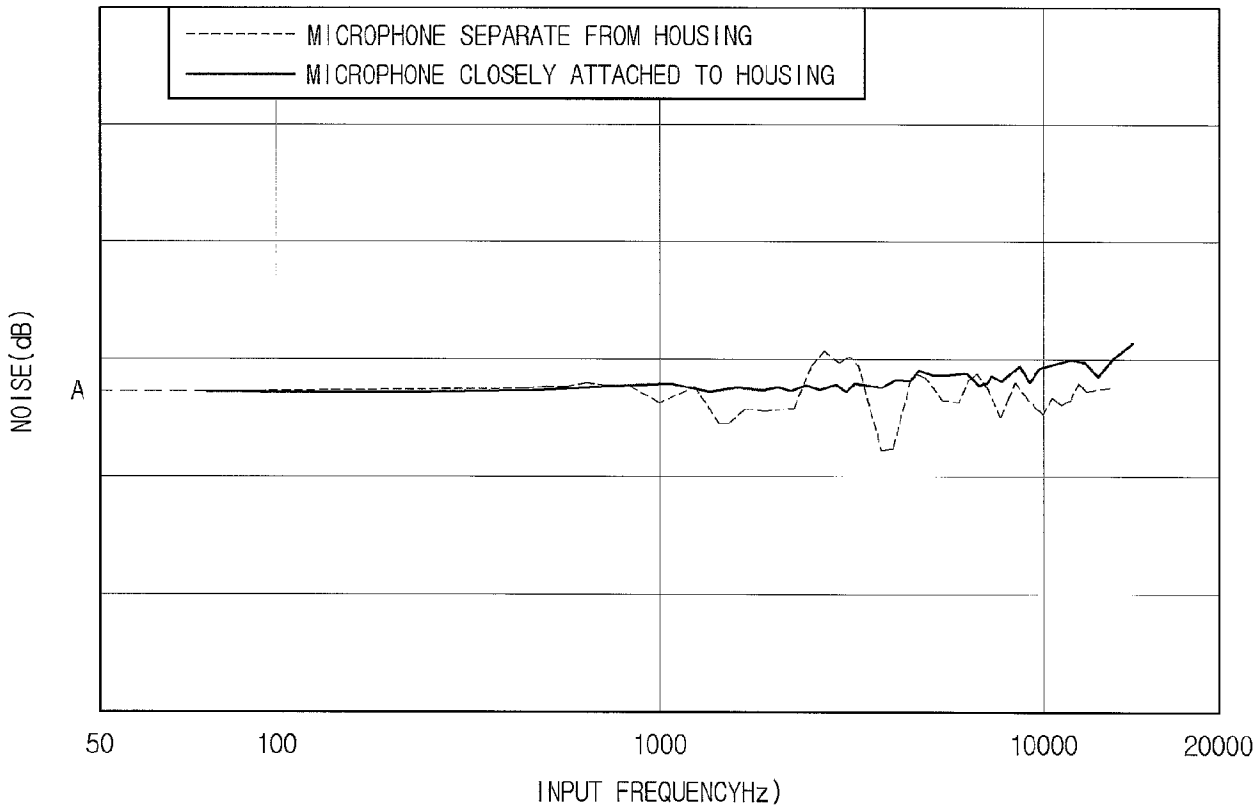
FIG. 10B is a graph illustrating responding properties in the magnitudes of frequencies collected by the microphone between a case when the microphone is separate from the housing and a case when the microphone is closely attached to the housing.

FIG. 10A is a cross-sectional view of a microphone 5 installed separate from the opening of the housing 120, and FIG. 10B is a graph illustrating responding properties in the magnitudes of frequencies collected by a microphone between a case in which the microphone is separate from the housing 120 and a case in which the microphone is closely attached to the housing 120.

In FIG. 10A, different from the previous embodiment described above, the microphone 5 is positioned a predetermined distance back from the microphone installation hole 133 by the a length L1.

In this case, since voices are reflected by an inner surface of a microphone supporting device 6 and transferred to the microphone 5, a voice transfer path directly heading for the microphone 160 as shown in FIG. 8 is not formed.

FIG. 10B is a graph illustrating, when audio signals, such as voices having various frequencies (input frequencies) of a certain volume are applied from the outside of the air conditioner, differences in volume of voices recognized by the microphone. Herein, the certain volume is shown as "A" on the graph.

A solid line shows responding properties in magnitude of the frequency of input voices with respect to the audio collecting device 100. A dotted line shows responding properties in magnitude of the frequency of input voices with respect to a audio collecting device (refer to FIG. 10A), which is a comparative example.

Referring to FIG. 10B, it may be known that a difference between the responding properties of the voice frequencies is not great until about 1,000 Hz.

On the contrary, within a range of frequency higher than 1,000 Hz, in case of disposing the microphone as shown in FIG. 10A, variation in magnitude increases. However, in case of disposing the microphone as shown in FIG. 8, the magnitude of voices is approximately uniformly maintained.

In other words, in a case of installing the microphone as shown in FIG. 10A, a frequency response of voices decreases. Also, considering that a frequency of voices of a human body is present within a range of from about 300 to about 3,400 Hz, the graph shows that responding properties according to a frequency of voices may be improved by providing the audio collecting device.

Accordingly, since the microphone 160 is disposed to be closely attached to the opening of the housing 120, that is, the microphone installation hole 133, voices collected outside the air conditioner 10 may be easily transferred to the microphone 160, thereby improving a voice command recognition rate.

In an air conditioner as embodied and broadly described herein, since a user may control operation of the air conditioner using audio/voice inputs, convenience of use may be enhanced.

Also, a microphone may be provided inside a housing and noise inside or outside the air conditioner may be shut out by the housing and not applied to the microphone, thereby facilitating collection of suitable audio/voice input.

Also, a noise insulation space defined by walls separate from the microphone may be provided inside the housing and may have a size capable of shutting out noises having a frequency within a certain range, thereby improving noise insulating properties.

Also, the microphone may be disposed to be closely attached to an opening of the housing, that is, a microphone installation hole, thereby improving responding properties of a audio volume according to a frequency of collected audio inputs.

Also, since a supporting member supporting the microphone may be provided inside the housing, deterioration of an audio/voice collecting rate, caused by vibrations of the microphone, may be prevented.

Accordingly, a recognition rate of audio/voice input collected through the microphone may be improved by shutting out extraneous noises.

Also, since the microphone is disposed on a side of the air conditioner and not exposed outwards, external appearance of the air conditioner may be maintained.

In one embodiment, an air conditioner as embodied and broadly described herein may include a body including an outlet and a voice collecting device provided on one side of the outlet and including a microphone collecting voices. Herein, the voice collecting device includes a housing body including an opening in which the microphone is installed, a housing cover provided on one side of the housing body, and a noise insulation space defined by the housing body and the housing cover and including previously determined width and height. Also, the microphone is disposed in the noise insulation space.

The housing body may include a first wall including the opening and a second wall extending from the first wall and defining a width of the noise insulation space in one direction.

The second wall may be provided as a plurality thereof, and the plurality of second walls may be coupled with the housing cover.

The voice collecting device may further include a supporting member coupled with one side of the first wall, supporting the microphone on the housing body, and formed with an insertion hole to which the microphone is fixed.

The supporting member may include a second coupling hole provided on at least one side of the insertion hole and aligned with a first coupling hole of a housing.

The microphone may be disposed adjacent or closely attached to the opening.

The microphone may be provided on an inside of the first wall, and a front of the microphone may form the same surface of an inner circumferential surface of the first wall.

The voice collecting device may further include a coupling unit coupled with the body to be separable, and a mounting part supporting the housing body may be provided in the coupling unit.

The housing body may be inserted into the mounting part and extends in one direction and another direction of the mounting part.

The microphone may be disposed to be separate from the second wall by a set distance.

A width W and a height H of the housing may be formed to be greater than a width and a height of the microphone, respectively.

The microphone may be disposed to be separate from the housing cover by a set distance.

The body may include a side panel forming a lateral external shape of the air conditioner, and the voice collecting device may be provided on the side panel.

The side panel may include a dent part dent toward an inside of the body and containing the housing and a settling part forming one surface of the dent part and allowing the housing cover to be settled thereon.

In another embodiment, an air conditioner as embodied and broadly described herein may include a panel including an outlet, a housing coupled with the panel, and a microphone contained in the housing and collecting voices. Herein, the housing includes a plurality of walls separate from the microphone and insulating noises not to be transferred to the microphone.

The plurality of walls may include a first wall including an opening in which the microphone is installed and a second wall extending from the first wall toward an inside of the panel.

The housing may include a housing cover coupled with the plurality of walls, and the microphone may be disposed to be separate from the housing cover.

The panel may include a dent part containing the housing and a settling part forming one surface of the dent part and allowing the housing cover to be settled thereon.

The air conditioner may also include a mounting part coupled with the dent part and supporting the housing.

The air conditioner may also include a supporting member coupled with the first wall and including an insertion hole for fixing the microphone.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a main body having an outlet formed therein; and an audio collecting device provided at the outlet, the audio collecting device including:

a microphone configured to receive audio inputs;

a housing body including a first wall having an opening formed therein and at least one second wall that extends from an edge of the first wall;

a housing cover provided on an open face of the housing body;

a noise insulation space defined by the housing body and the housing cover; and a support coupled with a side of the first wall that faces the noise insulation space and supports the microphone on the housing body, wherein the support includes an insertion hole formed therein to which the microphone is fixed, and wherein the microphone is provided within the noise insulation space, at a position corresponding to the opening formed in the housing body.

2. The air conditioner of claim 1, wherein the at least one second wall includes a plurality of second walls each extending back from a corresponding edge of the first wall to the housing cover so as to be coupled with the housing cover.

3. The air conditioner of claim 1, wherein the housing body includes a first coupling hole and the support includes a second coupling hole provided on at least one side of the insertion hole and aligned with the first coupling hole of the housing body.

4. The air conditioner of claim 1, wherein the audio collecting device further includes a coupling device separably coupled with the main body, and wherein the coupling device includes a mounting portion that supports the housing body.

5. The air conditioner of claim 4, wherein the housing body is inserted into and extends through a coupling opening formed in the mounting portion of the coupling device.

6. The air conditioner of claim 1, wherein the microphone is provided adjacent to or closely attached to the opening formed in the first wall of the housing body.

7. The air conditioner of claim 6, wherein the microphone is provided on an inner surface of the first wall, and wherein an exterior facing surface of the microphone is co-planar with the inner surface of the first wall.

8. The air conditioner of claim 1, wherein the microphone is coupled to the first wall and is spaced apart from the at least one second wall by a predetermined distance.

9. The air conditioner of claim 8, wherein a width and a height of the housing body are greater than a width and a height of the microphone, respectively.

10. The air conditioner of claim 1, wherein the microphone is positioned in the noise insulation space so as to be spaced apart from the housing cover by a predetermined distance.

11. The air conditioner of claim 1, wherein the main body includes a pair of side panels respectively forming a pair of opposite lateral sides of the air conditioner, and wherein the audio collecting device is mounted on one of the pair of side panels.

12. The air conditioner of claim 11, wherein the one of the pair of side panels on which the audio collecting device is mounted includes:

an installation recess which is recessed toward an inside of the main body and receives the housing body; and a seating portion forming one surface of the installation recess such that the housing cover is seated thereon.

13. The air conditioner of claim 1, wherein the support includes a supporting body coupled with the side of the first wall, and wherein the insertion hole is formed as a notch in the supporting body.

14. The air conditioner of claim 13, wherein at least a portion of the insertion hole is rounded corresponding to a shape of the microphone.

15. An air conditioner, comprising:

a panel including an outlet;

a housing coupled with the panel; and a microphone received in the housing and configured to receive audio inputs, wherein the housing includes a plurality of walls forming a noise insulation space in which the microphone is received, wherein the plurality of walls is separate from the microphone so as to block transfer of extraneous noises to the microphone, wherein the panel includes:

an installation recess that receives the housing; and a seating portion forming one surface of the installation recess such that a housing cover of the housing is seated thereon when the housing is received in the installation recess.

16. The air conditioner of claim 15, wherein the plurality of walls includes:

a first wall having an opening formed therein, wherein the microphone is installed in the noise insulation space at a position corresponding to the opening; and a second wall that extends from an edge of the first wall toward an interior side of the panel.

17. The air conditioner of claim 16, further including a support coupled with the first wall and having an insertion hole formed therein to which the microphone is coupled so as to fix the microphone to the first wall.

18. The air conditioner of claim 15, wherein the housing cover is coupled to the plurality of walls so as to enclose the noise insulation space, and wherein the microphone is installed in the noise insulation space separated from the housing cover.

19. The air conditioner of claim 15, further including a mounting portion which is coupled with the installation recess and supports the housing.

* * * * *